United States Patent [19]

Rhoades et al.

[11] Patent Number: 5,070,652

[45] Date of Patent: Dec. 10, 1991

[54] REVERSIBLE UNIDIRECTIONAL ABRASIVE FLOW MACHINING

[75] Inventors: Lawrence J. Rhoades, Pittsburgh; Thomas A. Kohut, North Versailles; Nicholas P. Nokovich, Greensburg, all of Pa.

[73] Assignee: Extrude Hone Corporation, Irwin, Pa.

[21] Appl. No.: 607,278

[22] Filed: Oct. 31, 1990

[51] Int. Cl.[5] ..... B24B 19/00

[52] U.S. Cl. ..... 51/7; 51/17; 51/317; 51/318

[58] Field of Search ..... 51/2 R, 7, 17, 317, 51/318, 326, 240 T, 215 AR, 292, 263, 428; 425/259; 134/195

[56] References Cited

U.S. PATENT DOCUMENTS 3,039,234 6/1962 Balman ..... 51/2 R
3,634,973 1/1972 McCarty ..... 51/21 R

FOREIGN PATENT DOCUMENTS 89-05710 6/1989 World Int. Prop. O. ..... 51/318

*Primary Examiner*—M. Rachuba
*Assistant Examiner*—Eileen Morgan
*Attorney, Agent, or Firm*—Waldron & Associates

[57] ABSTRACT

Undirectional abrasive flow machining is achieved by a pair of extrusion chambers, whereby a first workpiece is fixtured to a first of said chambers and an abrasive medium is extruded from the first chamber through the first workpiece, and upon exiting the first workpiece, is allowed to fall into and be collected within the second chamber. Thereafter, the first workpiece is removed and a second workpiece is fixtured to the second chamber so that the abrasive medium collected therein is extruded through the second workpiece and upon exiting the second workpiece, is allowed to fall into and be collected within the first chamber.

12 Claims, 4 Drawing Sheets

REVERSIBLE UNIDIRECTIONAL ABRASIVE FLOW MACHINING

BACKGROUND OF THE INVENTION

1. Summary of the Invention

This invention relates to abrasive flow machining, and more specifically to a new and improved method and apparatus for abrasive flow machining utilizing at least one pair of extrusion chambers with the workpiece fixtured to but one of the chambers, from which an abrasive medium is unidirectionally extruded through the workpiece and upon exiting from said workpiece, the abrasive medium is permitted to fall into the other extrusion chamber. By subsequently fixturing a second workpiece to the second extrusion chamber, the abrasive medium is extruded in the reverse direction in a like fashion, falling back into the first extrusion chamber, where the sequence can be repeated.

2. Summary of the Prior Art

Abrasive flow machining is a well known nontraditional machining process whereby a visco-elastic medium, permeated with an abrasive grit, is extruded through or past a workpiece surface to effect an abrasive working of that surface. The abrasive action in abrasive flow machining can be thought of as analogous to a filing, grinding, lapping, or honing operation where the extruded visco-elastic abrasive medium passes through or past the workpiece as a "plug". The plug becomes a self forming, conforming to the surface of the workpiece as it is extruded under pressure through the confined passageway, thereby working the selected surfaces of the workpiece.

While abrasive flow machining is somewhat similar to other abrasion techniques wherein fluids are used as a medium to carry an abrasive grit in suspension for similar abrasion treatments, (such as hydrodynamic machining) there are considerable differences. In applications where fluids are used; i.e., liquids or gases, very high velocities are essential, not only to maintain the grit particles in suspension, but because high speed impingement of the grit particles against the surface to be abraded is the essential force in such processes. All such hydrodynamic machining processes are limited by the laws of fluid dynamics and are not, therefore, capable of uniformly machining complex surfaces.

In the present invention, as in other abrasive flow machining processes, however, the visco-elastic abrasive medium is a semi-solid plastic extruded through the restrictive passageway under considerable pressure but with a relatively low velocity. The semi-solid plastic medium not only maintains the abrasive particles in a uniform suspension, but it further provides a relatively firm backing for the abrasive grit to hold the grit firmly against the passageway surfaces while the semi-solid, visco-elastic medium and grit are extruded through or past the workpiece. Hence, rather than impinging at high speeds against the surface to be abraded, the grit slowly and actively works the workpiece surface with a much higher working force than a high velocity grit suspended in a fluid as it forcibly moves along the surface walls to be abraded. Unlike more conventional abrading techniques where the abrasive particles are held against the workpiece by a solid base support, however, the medium supporting the abrasive particles is plastic, so that as a backing material it will conform to the cross-sectional shape of the passageway, turning corners and changing shape as the passageway turns corners and changes shape.

The typical prior art apparatus utilized in abrasive flow machining consists of a structure holding two directly opposed extrusion chambers with the workpiece insertable therebetween. The extrusion chambers are plastic extruding, positive displacement, expandable chambers, such as mechanically driven piston displacement cylinders, which can extrude the abrading medium from one extrusion chamber through the passageway of the workpiece and then into the other extrusion chamber. One or two removable workpiece fixtures, designed to hold the workpiece and seal the workpiece passageway to the extrusion chambers, must be secured between the workpiece and the two extrusion chambers. The workpiece fixture must be designed to securely hold the workpiece such that the workpiece surface to be worked is exposed within the passageway between the two extrusion chambers to permit the abrasive medium to be extruded into and from the workpiece without any leaks. If a surface to be abraded is merely a bore through the workpiece, the fixture must serve to merely seal each end of the bore to an extrusion chamber so that the bore itself becomes a sealed passageway between one extrusion chamber and the other. On the other hand, if the workpiece surface to be abraded is an external surface, the fixture is usually more complex and must be designed so that the workpiece and fixture together define the essential restricted passageway so that the surface to be abraded forms a portion of the passageway, and the medium will abrade at least that surface as it is extruded through the passageway.

Some of the earlier techniques for abrasive flow machining were unidirectional processes which utilized one extrusion chamber from which the abrasive medium was extruded through an inlet fixture and through the workpiece passageway and then allowed to fall onto the machine table or into a container upon exiting the workpiece. At some point in time it became necessary to reload the extrusion chamber with the abrasive medium collected. Because of the extra effort and time involved in transferring the medium back into the extruding chamber, this unidirectional technique soon gave way to the more rapid bidirectional technique of extruding the abrasive medium back and forth through one or more workpieces (as described above) thereby eliminating the need to manually reload the single medium chamber and significantly shortening the overall processing time.

At the start of a cycle of operation, the extruding medium, consisting of a semisolid, difficulty flowable, visco-elastic material permeated with an abrasive grit, is contained in one of the extrusion chambers, while the other chamber is empty or near empty. To perform the process, the abrasive medium is extruded, hydraulically or mechanically, from the filled chamber to the empty chamber via the restricted passageway through or past the workpiece surface to be abraded, thereby working the surface as desired. Typically, the extruding medium is then extruded bi-directionally back and forth between the two extrusion chambers to the extent necessary to effect the degree of abrasion desired. Counterbores, recessed areas, and even blind cavities can be abraded by using restrictors or mandrils to direct and guide the abrasive medium flow along the surfaces to be abraded. A more detailed description of the basic prior art on abrasive flow machining can be found in U.S. Pat. Nos.

3,521,412, McCarty; 3,634,973, McCarty; 3,802,128, Minear, Jr.; and 3,819,343, Rhoades.

While the prior art techniques are very effective, they do have their limitations with regard to certain workpiece characteristics. For example, some workpieces have complex geometries which make it difficult to design or apply fixtures that will effectively seal the opening to a passageway to be machined. As examples of such workpieces, some of the more advanced cylinder heads incorporating multiple intake and/or exhaust valves per cylinder are very difficult to fixture on both the manifold side and the piston cylinder side of the ports. In efforts to polish such intake or exhaust ports within such cylinder heads utilizing abrasive flow machining, it has been relatively easy to attach a fixture to the manifold side of the ports because the outer openings of the ports are usually located on a flat surface to which the intake or exhaust manifold will eventually be attached. The other ends of the ports, however, are not very easy to seal with a fixture because the port openings are normally very closely spaced within a domed or hemispherical cylinder head, which is further complicated by the fact that the dome will also contain a spark plug opening. While suitable fixtures can of course be designed, they are rather expensive to produce, and set-up time to properly mount the cylinder head workpiece to such fixtures can be rather time consuming if a seal adequate to prevent flow of the medium into areas such as exhaust ports and spark plugholes is to be achieved. In addition, reverse flow through such inlet ports does not work particularly well in most cases since the passageways are tapered in the opposite direction.

SUMMARY OF THE INVENTION

This invention is predicated on the conception and development of a new and improved process for abrasive flow machining utilizing two extrusion chambers but fixturing the workpiece to only one, to thereby unidirectionally extrude the abrasive medium through the workpiece, and upon exiting from the workpiece, the abrasive medium is allowed to fall into the other extrusion chamber, thereby eliminating the need for an outlet fixture. By subsequently fixturing another workpiece to the other extrusion chamber, the abrasive medium can be unidirectionally extruded back to the original extrusion chamber, thereby eliminating any need to manually or otherwise reload the abrasive medium at any point in the process. By eliminating the outlet fixture, the process and apparatus of this invention will not only eliminate the cost of the outlet fixture and eliminate the time necessary to properly affix the workpiece thereto but will significantly reduce the frictional forces to which the abrasive medium is subjected, thereby reducing medium heat buildup and reducing the medium wear and prolonging its useful life. Of particular significance, however, is the unique advantage afforded by this invention that it will make it far easier to abrasive flow machine particular workpieces which include surfaces that are difficult to seal to a fixture, and yet will permit extrusion from each extrusion chamber without the need for any separate reloading operation.

DESCRIPTION OF THE INVENTION

Figure 1:
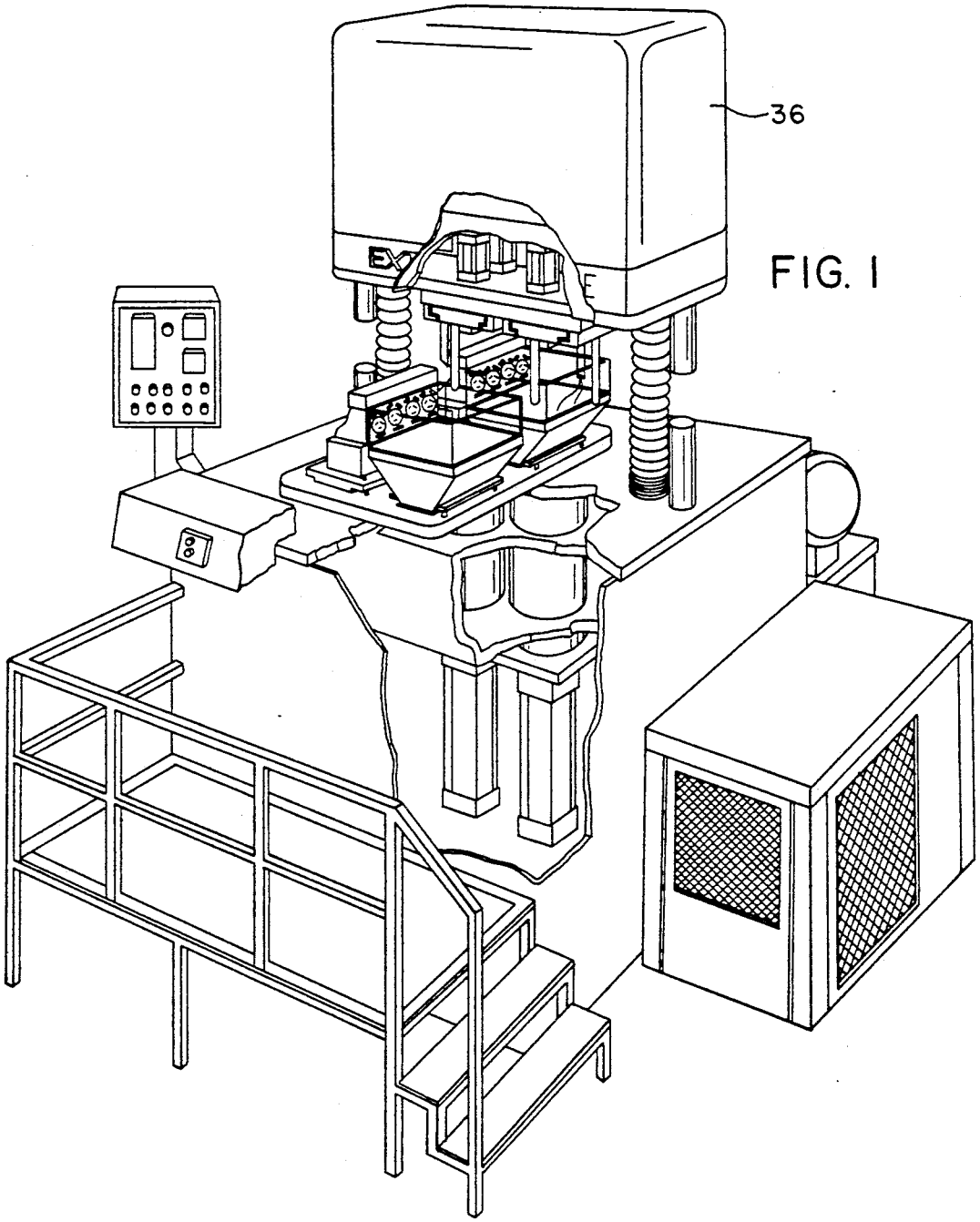
FIG. 1 is a partial cut-away, isometric view of an abrasive flow machining apparatus in accordance with one embodiment of this invention for machining intake and/or exhaust ports in cylinder heads for internal combustion engines, whereby two pairs of extrusion chambers are provided to abrade two cylinder heads simultaneously.
Figure 2:
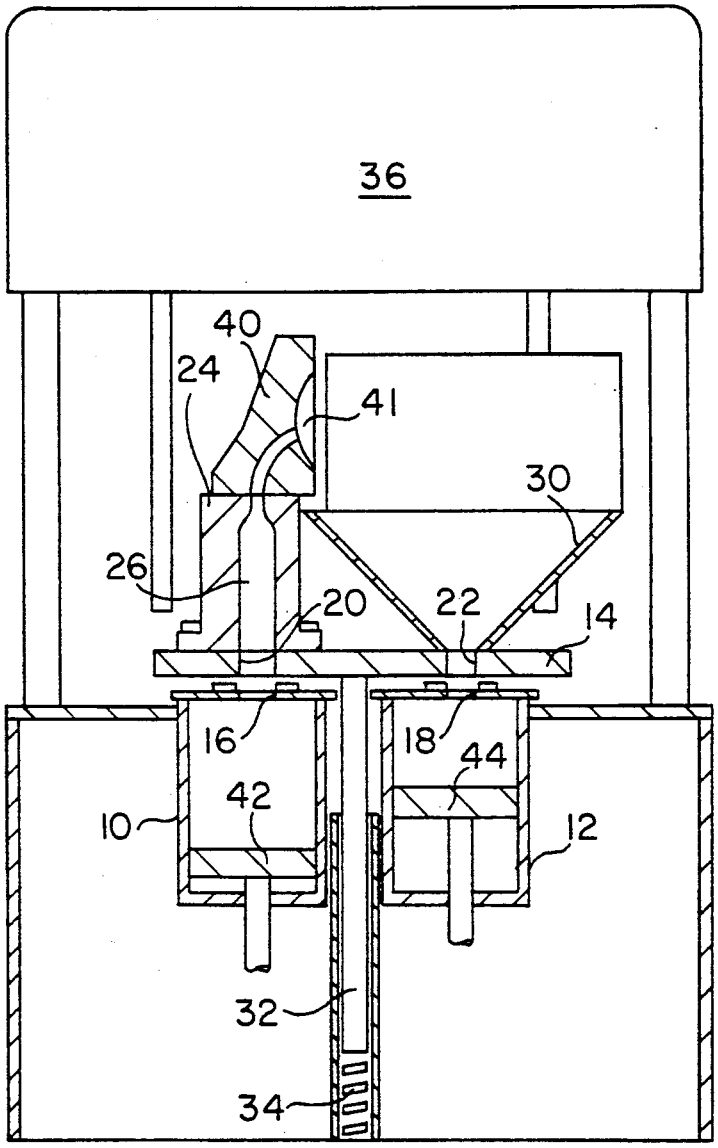
FIG. 2 is a schematic cross-sectional, elevational view of the apparatus shown in FIG. 1, showing the arrangement of components with regard to one pair of extrusion chambers during a first stage of the process.
Figure 3:
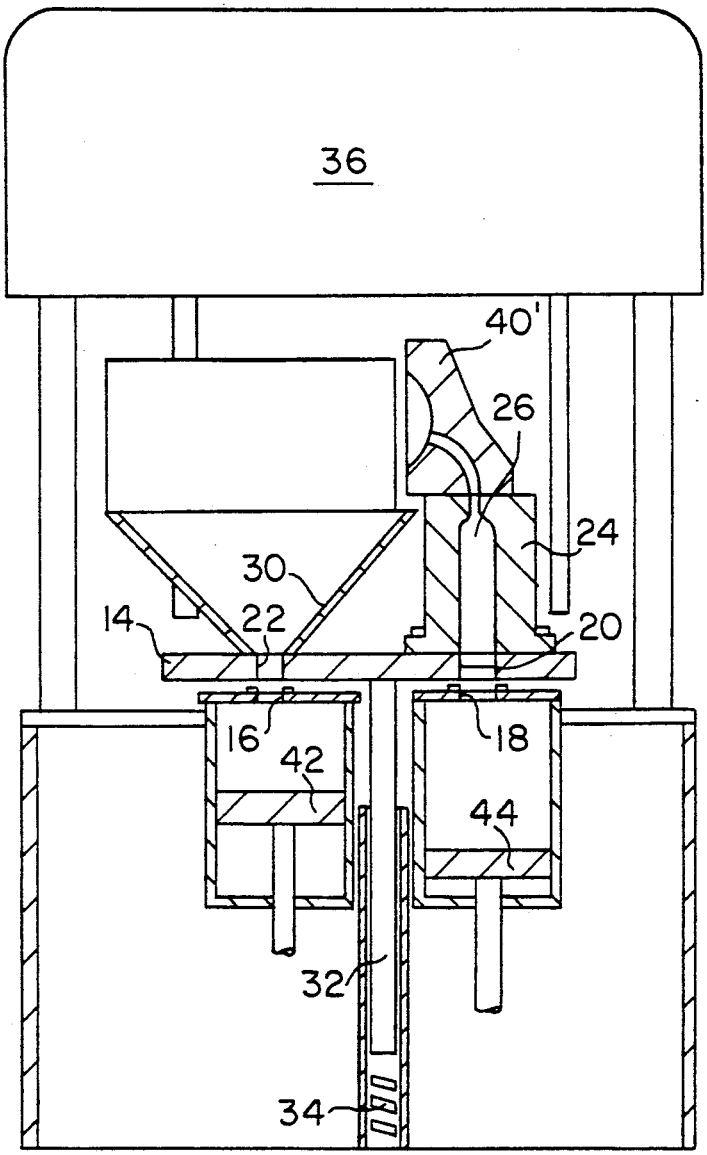
FIG. 3 is identical to FIG. 2 except that it shows the arrangement of components during a second, reverse stage of the process.

Reference to FIGS. 1–3 will illustrate one embodiment of this invention as utilized to abrade and polish the intake ports of cylinder heads for internal combustion engines. As shown in FIG. 1, the apparatus comprises two side-by-side extrusion chambers so that the apparatus as illustrated will sequentially process two workpieces; i.e., two cylinder heads. After the first cylinder head is processed, the rotary table is reindexed rotating the finished cylinder head from the process station to the load/reload station, while the unworked cylinder head is positioned over the process station.

Reference to FIGS. 2 and 3, which are cross-sectional elevations of the embodiment shown in FIG. 1, will better illustrate the details of the process where a pair of extrusion chambers 10 and 12 are rigidly positioned below one side of a rotatable fixture table 14, each of which chambers is provided with an opening 16 and 18 respectively through the upper surface. The rotatable table 14 is provided with two pairs of orifices 20 and 22 and 20' and 22' which are disposed so that either pair of the orifices can interchangably be aligned to simultaneously mate and communicate with opening 16 or 18, depending upon the position to rotatable table 14. The upper surface of rotatable table 14 is also provided with a pair of fixture/hopper combinations, each of which comprise a fixture 24, adopted to mate with orifice 20 such that a passageway 26 through fixture 24 is aligned with orifice 20, and a hopper means 30 adapted to mate with orifice 22 for purposes of guiding the falling abrasive medium through orifice 22.

Rotatable table 14 is not only mounted to axle shaft 32 for rotational motion around the axis of shaft 32, but is also spring mounted by any means, such as spring 34, so that rotatable table 14 can be biased downwardly to seal the orifice 20 and 22 therethrough to the properly mating openings 16 and 18. Accordingly, a hold-down means 36, such as a hydraulic press or screw jack, is mounted over rotatable table 14 for the purpose of pressing table 14 downwardly to seal orifices 20 and 22 to the respective openings 16 and 18 through extrusion chambers 10 and 12 respectively.

With references to FIG. 2 which illustrates the first stage of the process, workpiece 40, in this case a cylinder head, is mounted to fixture 24 so that the passageway 26 through fixture 24 will be aligned and communicate with the inlets to the passageways within the workpiece to be abraded. The outlet side of the workpiece passageway or passageways to be abraded are disposed over hopper means 30 so that the exiting abrasive medium will fall into the hopper means and from there into extrusion chamber 12. In this particular application, the passageways to be machined are the intake ports of the cylinder head. Preferably, therefore, the intake manifold side of the cylinder head workpiece 40 is tightly secured to fixture 26, preferably by utilizing the hold-down means 36 to hold and seal the workpiece 40 to the fixture 26.

To commence the first stage of the process, as illustrated in FIG. 2, rotatable table 14 is rotatably positioned so that fixture 24 and orifice 20 are positioned over extrusion chamber 10 and aligned to communicate with opening 16. At this point in the process extrusion chamber 10 contains the abrasive medium which is to be extruded through the workpiece. The hold-down means 36 is then activated to press rotatable table 14 downwardly thereby sealing orifices 20 and 22 against openings 16 and 18 in extrusion cylinders 10 and 12 respectively. Thereafter, extrusion chamber 10 is activated to cause piston 42 to move upwardly extruding abrasive medium within extrusion cylinder 10 through the passageway defined by opening 16, orifice 20, fixture passageway 26 and workpiece passageway 41, whereby the abrasive medium will abrade the passageway surfaces of workpiece 40 as desired. Upon exiting from the workpiece 40, the abrasive medium will fall into hopper means 30 where the force of gravity will cause it to be collected within extrusion chamber 12.

At some point in time the first stage of the process will be completed, normally when the workpiece 40 has been machined to the extent desired, or when extrusion chamber 10 has extruded all of the abrasive medium contained therein. Preferably, the apparatus is designed with sufficient extrusion chamber volume that the abrading action on each workpiece will be completed during each stage of the process, so that when each stage is completed, the finished workpiece can be removed and replaced by a fresh, unworked workpiece.

Before commencing the second stage of the process, hold-down means 36 is lifted from rotatable table 14 so that rotatable table 14 can be rotated to exchange the relative positions of orifice pairs 20/22 and 20'/22', and fixture/hopper combinations 24/30 and 24'/30'. Accordingly, orifice 20' and fixture 26' are repositioned to be aligned over extrusion chamber 12, as orifice 22' and hopper means 30' are repositioned to be aligned with extrusion chamber 10. Ideally, the workpiece 40 will have been abraded to the extent desired during the first stage, so that it can be removed from fixture 26 and replaced with a new workpiece while workpiece 40' is being processed. After the workpiece table has been rotated as noted, hold-down means 36 is reactivated to seal orifices 22' and 20' against openings 16 and 18 respectively. The abrasive medium in extrusion chamber 12 can then be extruded in the reverse direction substantially as it was extruded in the first stage, with the abrasive medium being returned to extrusion chamber 10 by falling therein via hopper means 30' and orifice 22'. Thereafter, the first stage can be repeated, preferable with another new workpiece.

In view of the above description, it is apparent that the receiving extrusion chamber into which the falling abrasive medium must be collected must be positioned so that the inlet opening will receive the falling abrasive medium. Therefore, the opening should face generally upwards or else be provided with a suitable hopper for catching and directing the falling medium to the opening. While it is not essential that the abrasive medium be extruded from an extrusion chamber through an upwardly facing opening, each of the extrusion chambers must function as a receiving chamber in its turn. As a practical matter, therefore, the openings through the extrusion chambers are preferable both generally in an upper surface of the chamber to facilitate receipt of the falling abrasive medium. While it is apparent that the openings could, for example, be positioned through a vertical wall portion of the extrusion chamber to facilitate extrusion of the abrasive medium from an extrusion chamber, any such orientation would only complicate the apparatus in requiring more complex hopper or guide means to get the falling abrasive medium into the receiving chamber. In a like manner, the outlet opening from the workpiece from which the abrasive medium must exit should face downwardly, or at least laterally, so that the fall of the abrasive medium can be controlled to fall into the receiving chamber or hopper means without collecting on the workpiece. In between the inlet opening through which the abrasive medium is extruded and the workpiece outlet from which the abrasive medium must fall, the passageway through which the abrasive medium must pass can take any form or direction. Obviously, should the abrasive medium exit the workpiece through an upwardly facing port, it would be far more difficult to guide and direct its fall into the appropriate extrusion chamber. If absolutely essential, however, an upwardly facing exit port could be tolerated, provided that suitable dams, guide means, or even a partial outlet fixture is provided to direct the exiting abrasive medium to a point where it will fall into the receiving extrusion chamber as is essential to reverse the process.

It should be apparent that numerous modifications and differing embodiments could be incorporated without departing from the spirit of the invention. While the above-described embodiment utilizes just one pair of extrusion chamber to process one workpiece at a time, two or more pairs of extrusion chambers could be provided to process two or more workpieces simultaneously.

As a simpler embodiment, the rotating table could be provided with just one set of orifices 20 and 22, one fixture 26 and one hopper means 30, extruding the abrasive medium back and forth through the same fixture and hopper means by merely exchanging their relative positions, and replacing the workpiece when ever it is finished. The above described embodiment does offer the advantage that a finished workpiece can be removed and replaced with a new workpiece to be processed during that time while a workpiece is being processed.

While the use of a rotatable table is a very convenient means for exchanging the fixture and hopper means to permit reversing of the extrusion, it is apparent that other techniques not utilizing a rotatable table could be utilized. In some applications, for example, it may indeed be more simple to merely selectively fixture the workpiece over the appropriate extrusion chamber without the need of any movable hardware. In still other variations of the process apparatus, it may not be necessary to provide a hopper means depending upon whether the falling abrasive medium can be guided into the receiving extrusion chamber without the need of a hopper. In still other embodiments, the hopper means may in fact consist of a partial outlet fixture which will guide the abrasive medium to a point where it can thereafter fall into the receiving extrusion chamber.

Figure 4:
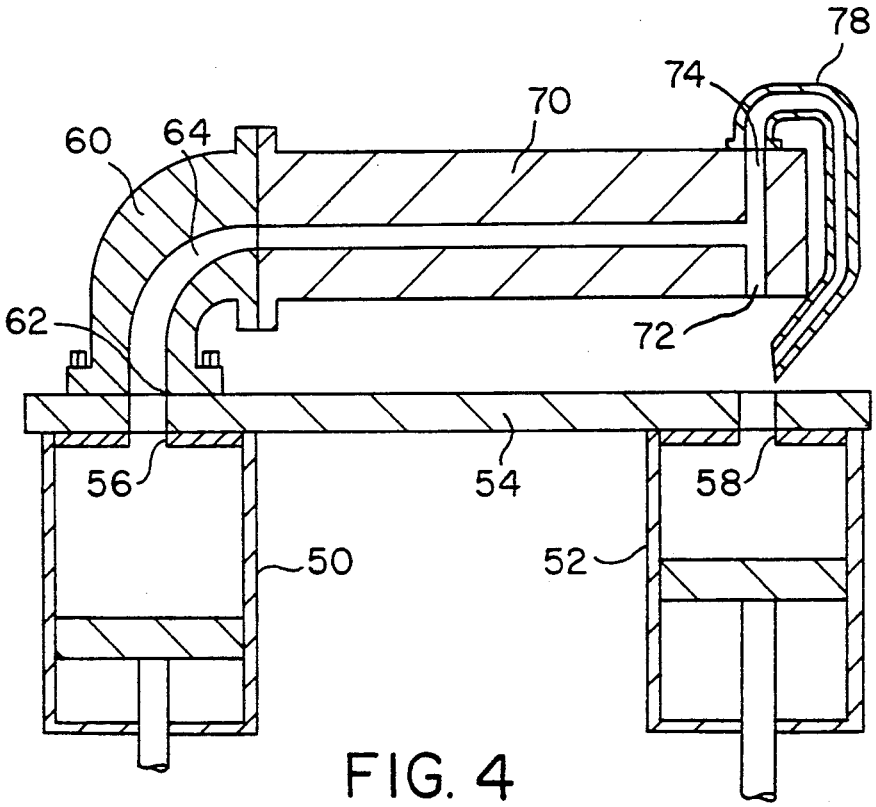
FIG. 4 is a schematic cross-sectional, elevational view of the apparatus according to another embodiment of this invention.

An example of such an embodiment which incorporates some of the above mentioned modifications is schematically illustrated in FIG. 4 wherein extrusion chambers 50 and 52 are rigidly secured to the underside of a stationary plate 54, having two ports therethrough so that one each communicates with the ports 56 and 58 in extrusion chambers 50 and 52 respectively. The fixture 60 is then clamped or bolted directly to plate 54 such that inlet port 62 is aligned with port 56 through extrusion chamber 50. Workpiece 70 is secured to fixture 60 such that any abrasive medium exiting therefrom via outlet port 72 will fall directly into extrusion cylinder 52 without the need for a hopper. Abrasive medium exiting from workpiece 70 via outlet port 74, however, is provided with a partial outlet fixture 78 which will guide the abrasive medium exiting port 74 to a point where it too can fall into extrusion chamber 52. To reverse the process for the second stage, fixture 60 is removed from its position as shown in FIG. 4 and rebolted over opening 58.

It should be apparent that the process of this invention does not necessarily entail the complete avoidance of any outlet fixturing whatsoever. While most applications of this invention can be achieved without any outlet port, it is recognized that in some rare instances at least a partial outlet fixture may be necessary, particularly if an exit port from the upper surface of the workpiece cannot be avoided. Even in these situations, however, a complete outlet fixture between the workpiece and receiving extrusion chamber will not be necessary. Any such outlet fixture will be useful only to the extent of guiding the exiting abrasive medium to a point where it can fall into the receiving extrusion chamber pursuant to the practice of this invention, and will not demand the critical sealing required for an outlet or reciprocal flow fixture.

While the above described apparatus and process are somewhat similar to that of the prior art, there are unique distinctions which offer considerable advantages, particularly with respect to the machining of workpieces which have at least one surface to which it is difficult to attach or seal a fixture. Specifically, permitting fall of the abrasive medium upon its exit from the workpiece will eliminate the need to fixture and seal the outlet side. It should be readily apparent that by virtue of the use of only one fixture, a cost savings can be realized by eliminating the need to manufacture an outlet fixture, and time can be saved by eliminating the need to affix and seal the outlet fixture. While this advantage is particularly beneficial with respect to workpieces which have a surface which is difficult to fixture, as noted above, the cost and time savings would be applicable when machining any workpiece regardless of the ease or difficulty in fixturing surfaces thereof. In addition to the above advantages, the use of a falling abrasive medium, as described above, as compared to a completely enclosed abrasive medium, will reduce the energy requirements in that no energy or force is required to extrude the abrasive medium from the workpiece to the return extrusion chamber. Additionally, the abrasive medium will not be subjected to frictional forces after it exits from the workpiece, which will naturally reduce the extent of wear on the abrasive particles; and further, the unconfined abrasive medium exposed to ambient air will tend to cool considerably during this period of time before it is re-compressed and re-extruded, which will further extend the useful life of the medium and perhaps even eliminate the need for any external medium cooling means as is sometimes necessary in conjunction with prior art abrasive flow machining apparatus.

What is claimed is:

1. An apparatus for the unidirectional abrasive extrusion machining of at least one passageway through a workpiece, wherein each said passageway has at least one inlet opening and at least one outlet opening, said apparatus comprising:

A. at least one pair of positive displacement extrusion chamber means for receiving an extrudable abrasive medium in a first, receiving position and sequentially extruding said abrasive medium in a second, extruding position;

B. an inlet fixture means for sequentially and sealably engaging said inlet opening to each of said extrusion chamber means in said second, extruding position and for directing extrusion of said abrasive medium from said extrusion chamber means into said inlet opening and through said passageway; and C. sequencing means for first associating one of said extrusion chamber means with said outlet opening in said first position to receive said abrasive medium discharged from said outlet opening, while associating the other one of said pair of extrusion chamber means with said inlet fixture means and said inlet opening of said passageway in said second position, and thereafter exchanging the operative positions of said pair of positive displacement chamber means in relation to said first and second positions, so that extrusion is solely unidirectional through said passageway from said inlet opening to said outlet opening.

2. The apparatus of claim 1, wherein said outlet opening is disposed over the positive displacement extrusion chamber in said first, receiving position so that the extrudable abrasive medium passing through said passageway drops unconfined into said chamber.

3. The apparatus of claim 1, wherein an outlet fixture means engages said outlet opening and the positive displacement extrusion chamber in said first, receiving position to direct flow of said extrudable abrasive medium from said outlet opening into said chamber.

4. The apparatus of claim 1, wherein said sequencing means comprises a rotary table disposed above said pair of positive displacement chambers, and wherein said workpiece and said inlet fixture means are fixed on said rotary table.

5. The apparatus of claim 4, wherein said inlet fixture means is engaged with the positive displacement extrusion chamber in said second, extruding position by a sealable port through said rotary table.

6. The apparatus of claim 1, wherein an outlet hopper is disposed beneath said outlet opening and above the positive displacement chamber in said first receiving position to collect flow of said extrudable abrasive medium from said outlet opening and to direct said flow into said chamber.

7. The method of unidirectional abrasive extrusion machining of at least one passageway through a workpiece, wherein each said passageway has at least one inlet opening and at least one outlet opening, said method comprising:

A. engaging said outlet opening with a first positive displacement extrusion chamber in a first receiving position;

B. sealing said inlet opening into engagement with a second positive displacement extrusion chamber containing an extrudable abrasive medium in a second, extruding position;

C. extruding said abrasive medium from said second positive displacement chamber in said second extruding position, into said inlet opening, through said passageway, out of said outlet opening, and into said first positive displacement chamber in said first position;

D. thereafter sequentially exchanging the operative positions of said first positive displacement extrusion chamber and said second positive displacement extrusion chamber in relation to said first and second positions whenever the extrudable abrasive medium of the positive displacement extrusion chamber in said second, extruding position is substantially depleted of said extrudable abrasive medium, so that extrusion is solely unidirectional through said passageway, from said inlet opening to said outlet opening.

8. The method of claim 7, wherein said operative positions are sequentially exchanged by rotation of said workpiece relative to said first, receiving and said second, extruding positions.

9. The method of claim 8, wherein said rotation is effected by a rotary table.

10. The method of claim 7, wherein the flow of said extrudable abrasive medium from said outlet opening to said positive displacement extrusion chamber in said first, receiving position is unconfined.

11. The method of claim 7, wherein the flow of said extrudable abrasive medium from said outlet opening to said positive displacement extrusion chamber in said first, receiving position is confined by a hopper disposed above said chamber and below said outlet opening.

12. The method of claim 7, wherein the flow of said extrudable abrasive medium from said outlet opening to said positive displacement extrusion chamber in said first, receiving position is directed by outlet fixture means.

* * * * *